US009637356B2

(12) United States Patent
Birch et al.

(10) Patent No.: US 9,637,356 B2
(45) Date of Patent: May 2, 2017

(54) COLLAPSIBLE HOISTING APPARATUS

(71) Applicant: HOIST AROUND LLC, Tucson, AZ (US)

(72) Inventors: Kevin John Birch, Tucson, AZ (US); Raymond Scott Birch, Tucson, AZ (US); Steven Adam Berry, Tyrone, NM (US); Raymond Francis Birch, Tucson, AZ (US)

( * ) Notice: Subject to any disclaimer, the term of this patent is extended or adjusted under 35 U.S.C. 154(b) by 0 days.

(21) Appl. No.: 14/570,855

(22) Filed: Dec. 15, 2014

(65) Prior Publication Data

US 2016/0167933 A1 Jun. 16, 2016

(51) Int. Cl.
*B66C 23/44* (2006.01)

(52) U.S. Cl.
CPC ..... *B66C 23/44* (2013.01)

(58) Field of Classification Search
CPC ..... B66C 23/44; B66C 23/42; B66C 23/70
USPC ..... 254/323
See application file for complete search history.

(56) References Cited

U.S. PATENT DOCUMENTS 4,614,252 A * 9/1986 Tarner ..... A01M 31/02 182/116
4,824,278 A * 4/1989 Chang ..... E06C 1/32 16/332
5,236,062 A * 8/1993 Laney ..... A01M 31/02 182/116
5,964,565 A * 10/1999 Skotzky ..... B60R 9/042 224/309
6,155,771 A * 12/2000 Montz ..... B66C 23/44 212/180
6,371,314 B1 * 4/2002 Boisvert ..... B66C 23/44 212/180
6,607,345 B2 * 8/2003 McElhany ..... B60P 1/4407 414/462
6,609,481 B1 * 8/2003 McCarty ..... A01K 15/00 119/512
6,769,858 B1 * 8/2004 Butler ..... B60P 1/4421 414/462
7,168,521 B1 * 1/2007 Murray ..... A01M 31/02 182/116
7,293,951 B2 * 11/2007 Meeks ..... B60P 1/4407 414/462
2002/0066710 A1 * 6/2002 Spitsbergen ..... B66C 23/44 212/179

* cited by examiner

*Primary Examiner* — Emmanuel M Marcelo
(74) *Attorney, Agent, or Firm* — Griffiths & Seaton PLLC

(57) ABSTRACT

A collapsible hoist apparatus includes a lower boom assembly, a middle boom assembly, and an upper boom assembly, the boom assemblies consisting of two parallel boom arms and a transversal crossbeam, and are connected to one another by a pivotal annular support. The annular support allows the complete boom assembly to be placed in a first extended position, such that the boom assemblies extend outwardly, aligned in a pleated configuration; a fully extended position, such that the boom assemblies extend outwardly, aligned in a planar configuration; or a closed storage position, such that the boom assemblies extend inwardly, aligned in a pleated configuration.

20 Claims, 14 Drawing Sheets

COLLAPSIBLE HOISTING APPARATUS

BACKGROUND OF THE INVENTION

Field of the Invention

The present disclosure relates in general to hoists and, more specifically, to a hoist which is collapsible for storage.

Description of the Related Art

Hunting is a multi-billion dollar industry with sustained popularity. Sportsmen often use all-terrain vehicles (ATV's), or utility terrain vehicles (UTV's) for transport to and from the field. Many of these vehicles are equipped with a winch. While hunting, sportsmen are required to field dress wild game animals. In order that the carcass be preserved properly, and to avoid contamination, many hunters choose to suspend the carcass during field dressing.

As wild game can weigh many hundreds of pounds, suspending the carcass requires a lifting or hoisting device. Unfortunately, most hoists are very impractical to take to the field or campsite. Collapsible hoists often require complete disassembly, which is not preferred in the field due to the time and tools required to assemble and disassemble. Additionally, prior collapsible hoists have required to be mounted onto a truck or vehicle with a bumper assembly and receiver hitch. These generally are large vehicles that often are left at a basecamp, in favor of taking smaller ATV's or UTV's to the desired hunting location.

SUMMARY OF THE INVENTION

A collapsible hoist assembly that may be mounted long-term to an all-terrain vehicle (ATV) or utility-terrain vehicle (UTV), takes advantage of the vehicle's winch, and is compactly storable such as not to inhibit normal vehicle operation would be advantageous. To address issues seen in the prior art relating to collapsible hoists, in one embodiment, by way of example only, a collapsible hoist apparatus is taught herein that includes three pivotally connected and collapsible boom assemblies which comprise a pleated complete boom assembly, permanently mountable to a vehicle such as an ATV or UTV, by a mounting assembly fastened to common points associated with many vehicle models. The pleated complete boom assembly provides for a hoist apparatus that is easily operable in a plurality of positions and angles according to the application for use, yet collapsible into itself such as to enable the assembly to store compactly and without inhibiting vehicle operation, thereby making it practical to mount onto a vehicle long-term.

Once the hereinafter-taught hoist apparatus is attached to a vehicle, it is operable with no special tools or assembly, and may be capable of lifting a very substantial amount of weight. In one example, the hoist apparatus mounted to an ATV or UTV is ideal for hoisting the considerable weight of large game animal being field dressed, using the vehicle's winch. Many other applications may benefit from such an assembly, and the provided embodiments serve as examples only.

In accordance with a broad aspect of the present invention, one such embodiment relates to a collapsible hoist apparatus, comprising a lower boom assembly, a middle boom assembly, and an upper boom assembly, said boom assemblies connectible to one another by a pivotal annular support; wherein the annular support allows the complete boom assembly to be placed in a first extended position, a fully extended position, or a closed storage position.

In accordance with another broad aspect of the present invention, there is provided a collapsible hoist apparatus comprising a lower boom assembly, a middle boom assembly, and an upper boom assembly, said boom assemblies including two parallel boom arms and a transversal cross-beam, and connectible to one another by a coaxially pivotal annular support; wherein the annular support allow the complete boom assembly to be placed in a first extended position, such that the boom assemblies extend outwardly, aligned in a pleated configuration; a fully extended position, such that the boom assemblies extend outwardly, aligned in a planar configuration; or a closed storage position, such that the boom assemblies extend inwardly, aligned in a pleated configuration. Other apparatus, assemblies, and associated methods are also disclosed.

The foregoing Summary has been provided to introduce a selection of concepts in a simplified form that are further described below in the Detailed Description. The Summary is not intended to identify key features or essential features of the claimed subject matter, nor is it intended to be used as an aid in determining the scope of the claimed subject matter. The claimed subject matter is not limited to implementations that solve any or all disadvantages noted in the background.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE DRAWINGS

The following detailed description of the invention merely provides exemplary embodiments and is not intended to limit the invention of the application and uses of the invention. Furthermore, there is no intention to be bound by any theory presented in the preceding background of the invention of the following detailed description of the invention.

Embodiments of the present invention described below provide an improved collapsible hoist apparatus. The hoist assembly may be used in a variety of applications, an exemplary application used for hoisting game animal to aid in field dressing. The present invention is extendable to a plurality of positions angles, and requires no tools to operate as seen in prior art counterparts. Collapsible hoists according to the present invention are mountable long-term to all-terrain vehicles (ATV's) and utility-terrain vehicles (UTV's, and take advantage of the vehicle's winch. Collapsible hoists according to the present invention are storable easily and without the need for tools, as seen in prior art counterparts. All embodiments of the present invention described herein are examples of implementations of the present invention and should not be taken in a limiting sense.

Figure 1:
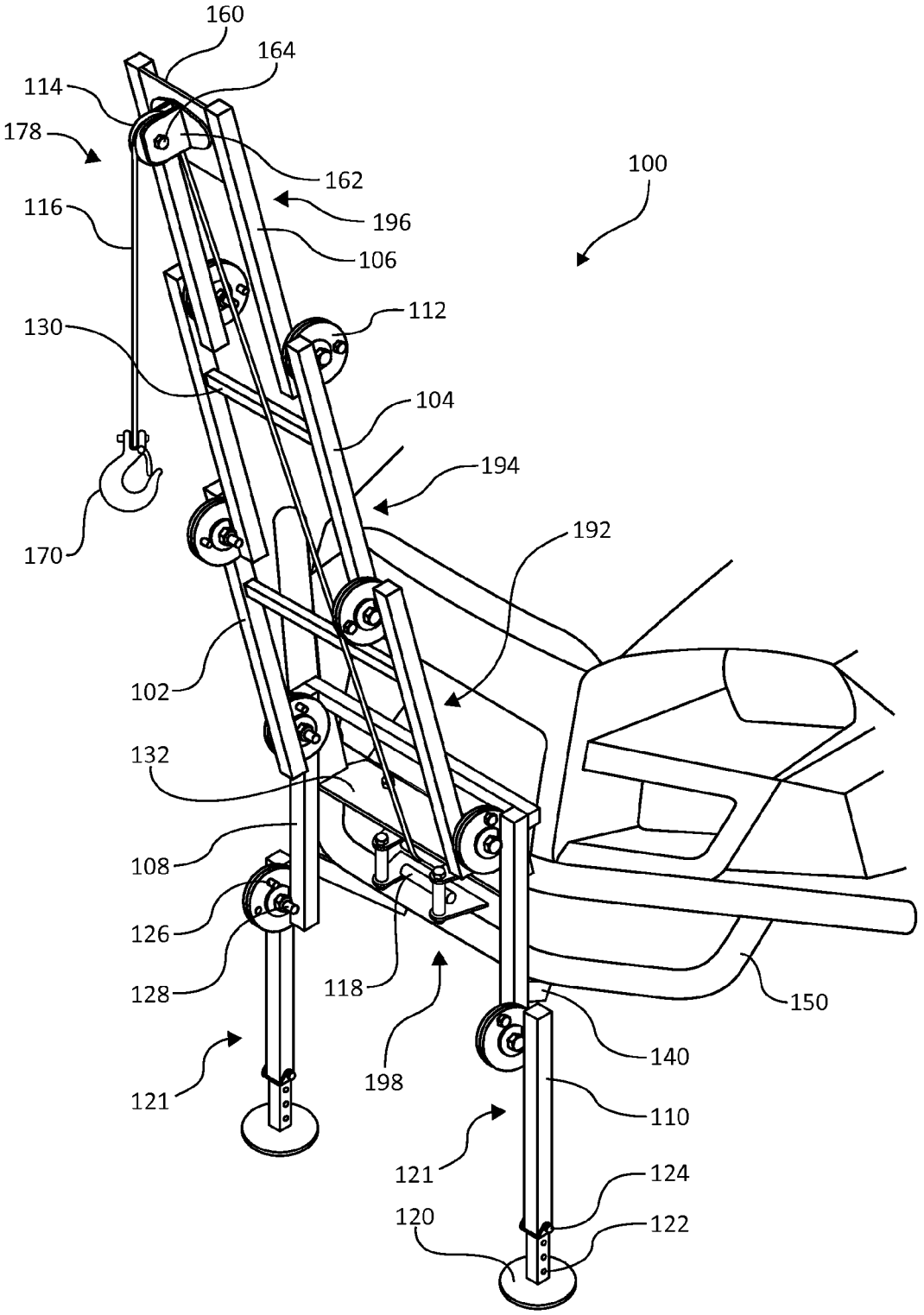
FIG. 1 is a perspective view illustration of an assembly according to one embodiment of the present invention in a fully extended, "ready for use" position.

Turning now to the figures, FIG. 1 illustrates one example of a collapsible hoist assembly according to the present invention. The collapsible hoist assembly includes a complete boom assembly 100, which includes a lower boom assembly 192, a middle boom assembly 194, and an upper boom assembly 196; a mounting assembly 198, and a support post assembly 121 with support posts 110. The lower boom assembly 192 consists of two parallel boom arms 102, connected by a lower transversal cross beam 180; middle boom assembly 194 consists of two parallel boom arms 104, connected by a middle transversal cross beam 130; and upper boom assembly 196 consists of two parallel boom arms 106, connected by a cable-pulley assembly support 160. The lower transversal cross beam 180 binds lower boom arms 102 in the mid-to-upper quarter of lower boom assembly 192; the middle transversal cross beam 130 binds middle boom arms 104 in the mid-to-upper quarter of middle boom assembly 194; and the cable-pulley assembly support 160 binds upper boom arms 106 at the upper extended end of upper boom assembly 196.

In one embodiment, the lower transversal cross beam 180 of the lower boom assembly 192 is spaced longer than that of the middle transversal cross beam 130 of the middle boom assembly 194, and the middle transversal cross beam 130 of the middle boom assembly 194 is spaced longer than that of the cable-pulley assembly support 160 of the upper boom assembly 196, such that the upper boom assembly 196 is narrower than, and fits inside and in between the middle boom assembly 194, and the middle boom assembly 194 is narrower than, and fits inside and in between the lower boom assembly 192. Each of the upper boom assembly 196, middle boom assembly 194, and lower boom assembly 192, pivots to rotate coaxially independently upon, and is connected to each other via an annular support 112 positioned on each extended end, of each side of each of the lower boom arms 102 of the lower boom assembly 192, and each extended end, of each side of each of the middle boom arms 104 of the middle boom assembly 194. The upper boom assembly 196 contains an annular support 112 on each lower end (i.e. the end of the upper boom assembly 196 connected to the middle boom assembly 194) of each of the upper boom arms 106 only.

In one embodiment, the upper boom assembly 196 is connected to the end of, and spaced directly inward of the middle boom assembly 194 by annular support 112. The middle boom assembly 194 is connected to the end of, and spaced directly inward of the lower boom assembly 192 by annular support 112, such that in a stored position, each boom section fits between and adjacent the previous boom section in a folded, pleated configuration. The complete boom assembly 100, consisting of the lower boom assembly 192, middle boom assembly 194, and upper boom assembly 196 are then connected via an annular support 112 to mounting arms 108 of mounting assembly 198. A boom assembly may be fabricated of steel, stainless steel, cast iron, alloy steel, aluminum, plastic or polymers, or any other material or combination thereof suitable for use in such an application, not limited to the aforementioned.

Figure 3:
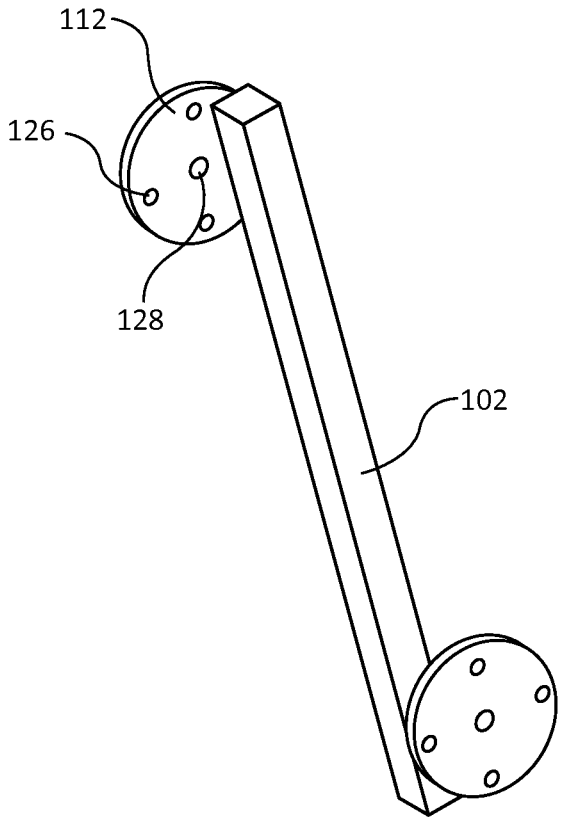
FIG. 3 is an enlarged, perspective view illustration of a middle boom, according to one embodiment of the present invention.
Figure 4:
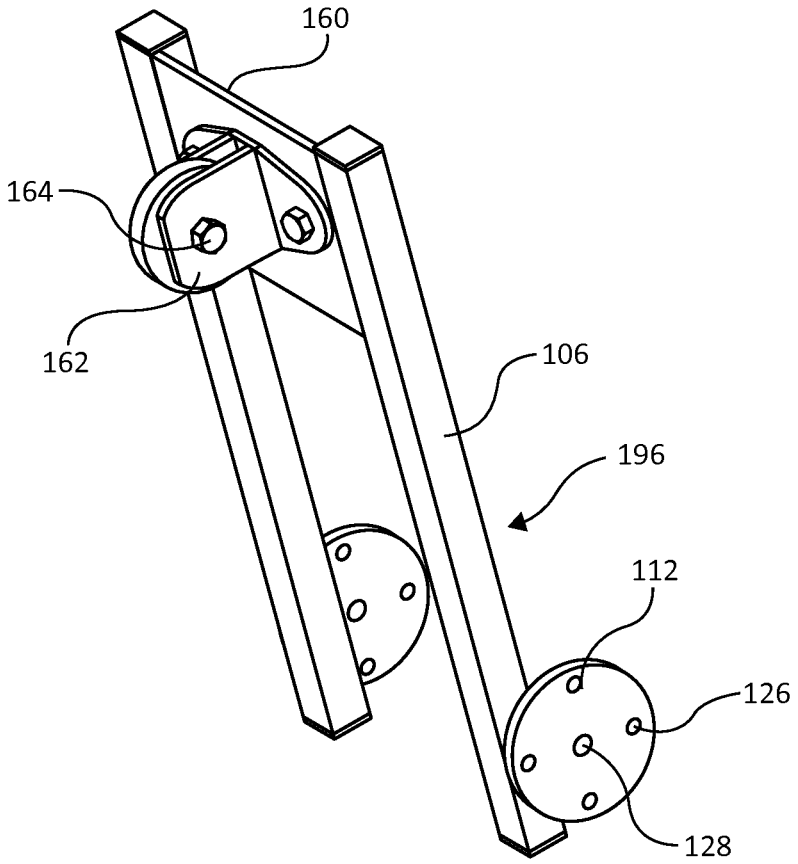
FIG. 4 is an enlarged, perspective view illustration of an upper boom, according to one embodiment of the present invention.

As previously stated, and as illustrated in FIG. 1, annular support 112 connects upper boom assembly 196 to middle boom assembly 194, middle boom assembly 194 to lower boom assembly 192, and the lower boom assembly 192 to mounting assembly 198. In one embodiment, illustrated in FIG. 3, annular support 112 is comprised of two cylindrical plates, one plate connected to each end of each lower boom arm 102, one plate connected to each end of each middle boom arm 104, and (as illustrated in FIG. 4), one plate connected, adhered, ultrasonically welded, chemically bonded, electrostatically coupled, mechanically coupled, or otherwise suitably coupled to one end of each upper boom arm 106. Each plate has a middle aperture in which two plates are joined together via a fastener, and further serves as a coaxial pivotal point 128. In one embodiment, annular support 112 has a plurality of outwardly spaced apertures along the outer edge, to accommodate a fastener 126. In another embodiment annular support 112 has a two outwardly spaced apertures to accommodate a fastener.

The annular support 112, coaxial pivot point 128, and fastener 126 thereof are the points of which stress of the weight lies when performing a lift, and are reinforced accordingly. A fastener may be a locking pin, cotter pin, spring pin, linchpin, bolt, threaded insert, or otherwise suitable fastening device. The coaxially pivotal movement of annular support 112 makes it possible to adjust the angle at which the boom is set, while affirming and locking its position with fastener 126, as to prohibit further pivoting or rotational movement.

Figure 5:
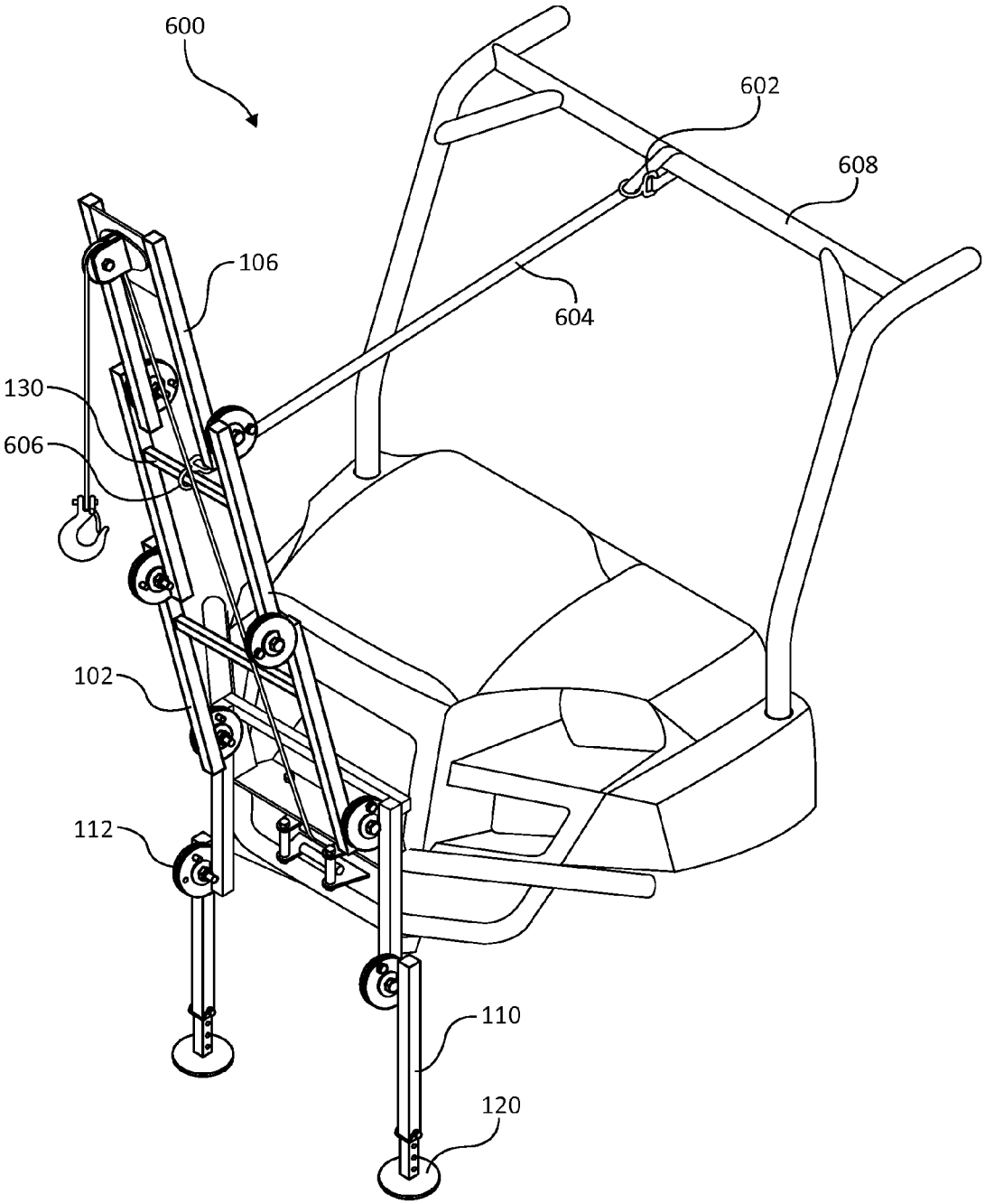
FIG. 5 is a perspective view illustration of an assembly and support strap, according to one embodiment of the present invention.

In one embodiment, as illustrated in FIG. 5, upper boom assembly 196 has attached a cable-pulley mount support 160 on the outward end of the boom assembly to which a cable-pulley assembly 178 is attached. The cable-pulley assembly consists of a pulley 114, a fastener 164, and a pulley housing 162. In the one embodiment, illustrated in FIG. 1, the cable-pulley assembly 178 is served by a cable 116, threaded between the pulley housing 162 and the pulley 114. A winch 118 mounted to the ATV, UTV, or otherwise suitable vehicle, having a cable 116 with a hook 170 or other suitable connecting device provides the agent for the lift. When operable, the cable 116, originating at the vehicle winch 118, is pulled, threaded through, and resting on the cable-pulley assembly 178, with the outward cable end suspended. A load desirous to be lifted is secured to the cable hook 170 or other suitable connecting device.

A suitable connecting device may be a hook, d-ring, shackle clevis, tow hook, carabiner, snaphook, or other device or combination thereof suitable for securing a load in such an application. Furthermore, an agent providing the lift may be a cable, rope, chain, wire, or any other material or combination thereof suitable for the application. In one example, cable 116 may be chain link, and pulley 114 a sprocket. Many variations of lift agents and connecting devices may exist, any aforementioned are merely simplistic examples.

Figure 12:
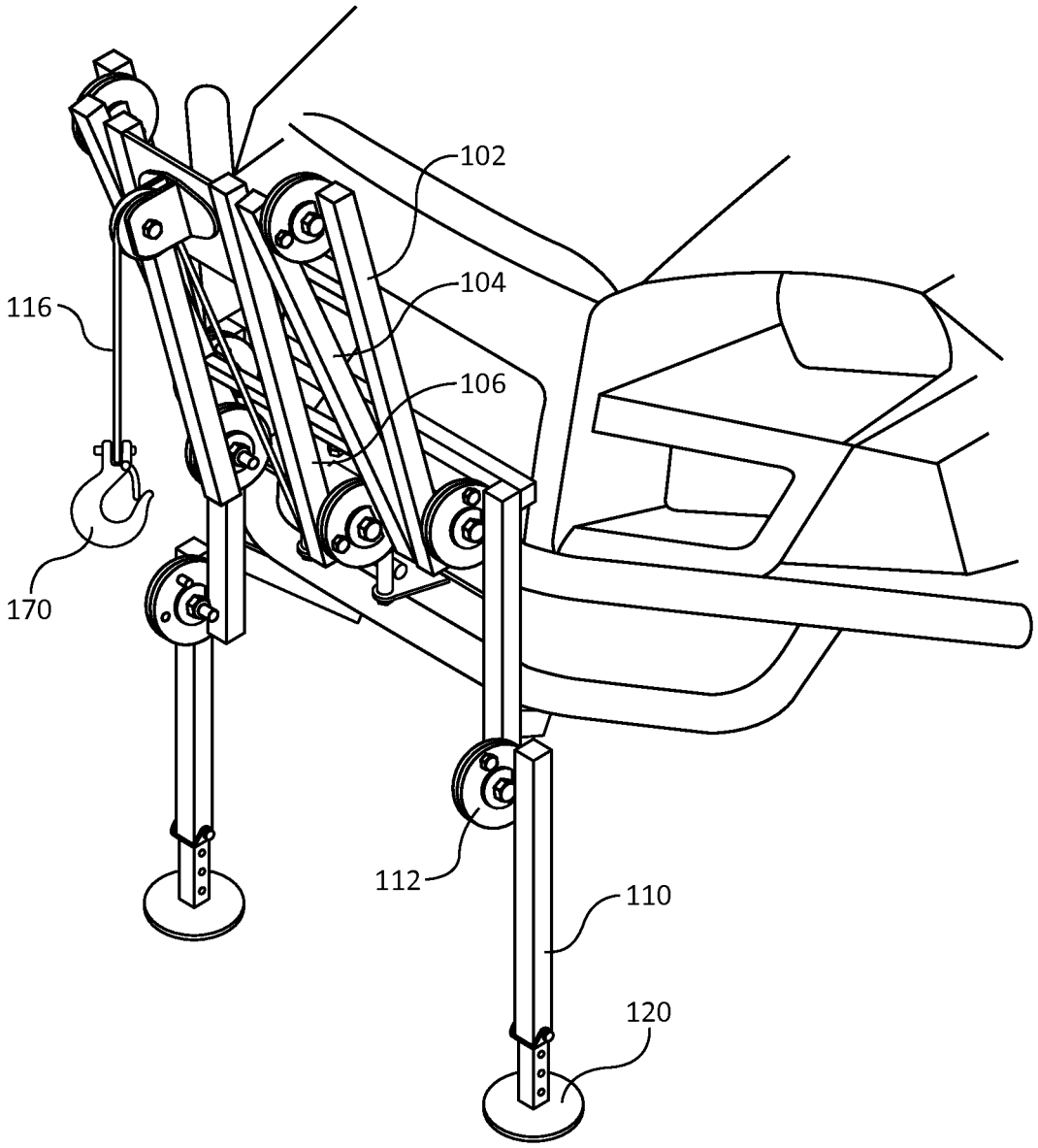
FIG. 12 is a perspective view illustration of an assembly according to one embodiment of the present invention in the extended "ready for use" position.

In one example, in operation, the upper boom assembly 196, middle boom assembly 194, and lower boom assembly 192 may be placed in a first extended position, as illustrated in FIG. 12. In a first extended position, the lower boom assembly 192, middle boom assembly 194, and upper boom assembly 196 are positioned inside one another in a pleated configuration, such that each upper boom arm 106 is positioned at the same height and adjacent to middle boom arms 104 and the lower boom arms 102. The complete boom assembly 100 is then connected to, and angled away from the vehicle using annular support 112. In one example, when it is desired the boom assembly be put in this position, a fastener 126 of annular support 112 is released on each lower end of each lower boom arms 102, allowing annular support 112 to pivot rotationally outward away from the vehicle upon pivot fastener 128, until the desired aperture on both annular plates align, upon which fastener 126 is threaded and secured into the aligned apertures as to not allow further rotational movement. The angle at which the complete boom assembly 100 operates is dependent upon which of the plurality of apertures the fastener is placed into on the outer edge of annular support 112.

Figure 11:
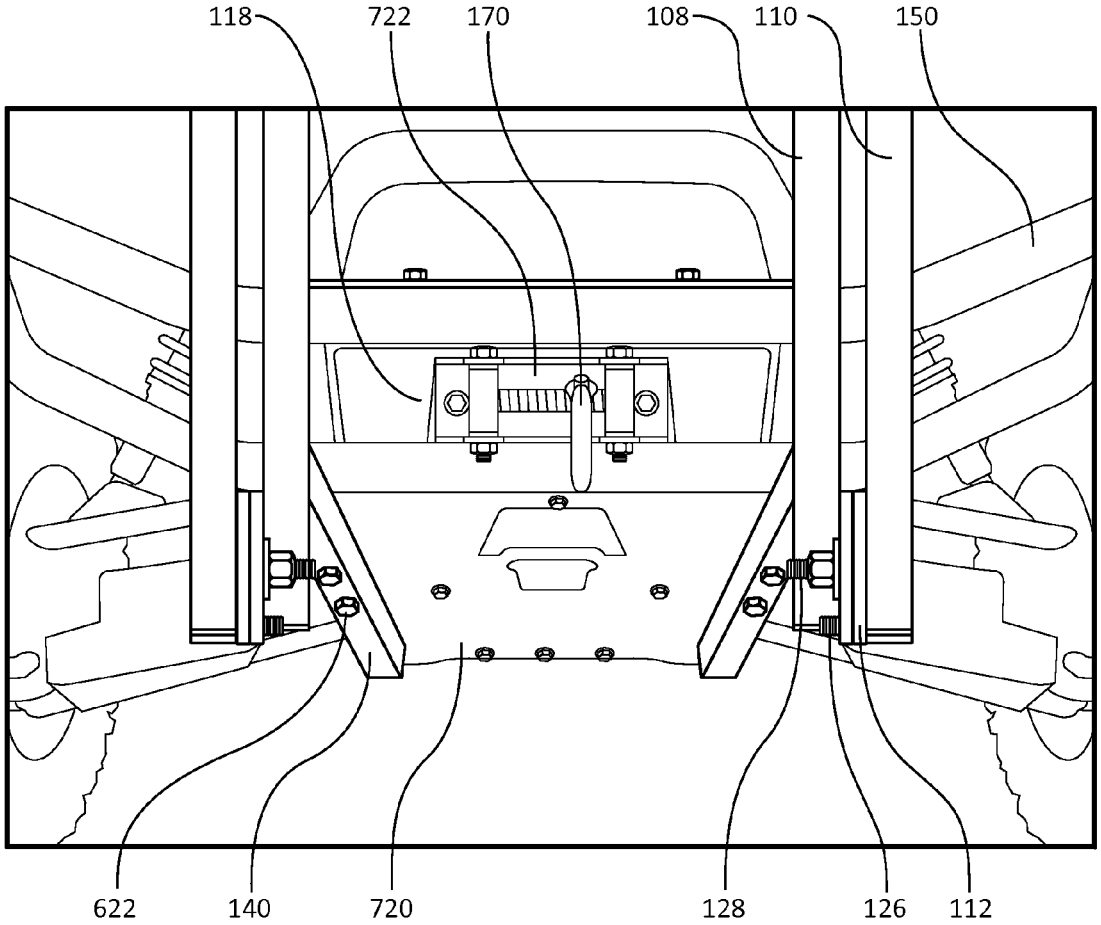
FIG. 11 is a perspective view illustration of a mounting assembly according to one embodiment of the present invention.

In another example, in operation, the boom assemblies may be placed in a fully extended position, as demonstrated in FIG. 1. In a fully extended position, the lower boom assembly 192, middle boom assembly 194, and upper boom assembly 196 are placed in a planar configuration extending at a desired angle outward from the vehicle. By releasing fastener 126 of annular support 112 on each end of each lower boom arms 102, middle boom arms 104, and upper boom arms 106, each boom assembly is free to pivot rotationally upon pivot fastener 128 of annular support 112, until the aperture on both connected annular plates align, at which the boom assemblies are in their most outwardly extended position. Fastener 126 is then threaded and secured into the aligned apertures fastening both annular plates together, as to not allow further rotational movement and locking the boom assembly in place. The angle at which the complete boom assembly 100 operates may be determined by which aperture on outer edge of annular support 112, fastener 126 is placed into. In both aforementioned examples, in either a first extended position or a fully extended position, winch cable (or other suitable material) 116 is threaded between pulley housing 162 and pulley 114, using pulley 114 of the upper boom assembly 196 as an upper tensional fulcrum support for the lift, and using the upper winch guide 722, illustrated in FIG. 11, as a lower tensional fulcrum support.

Figure 6:
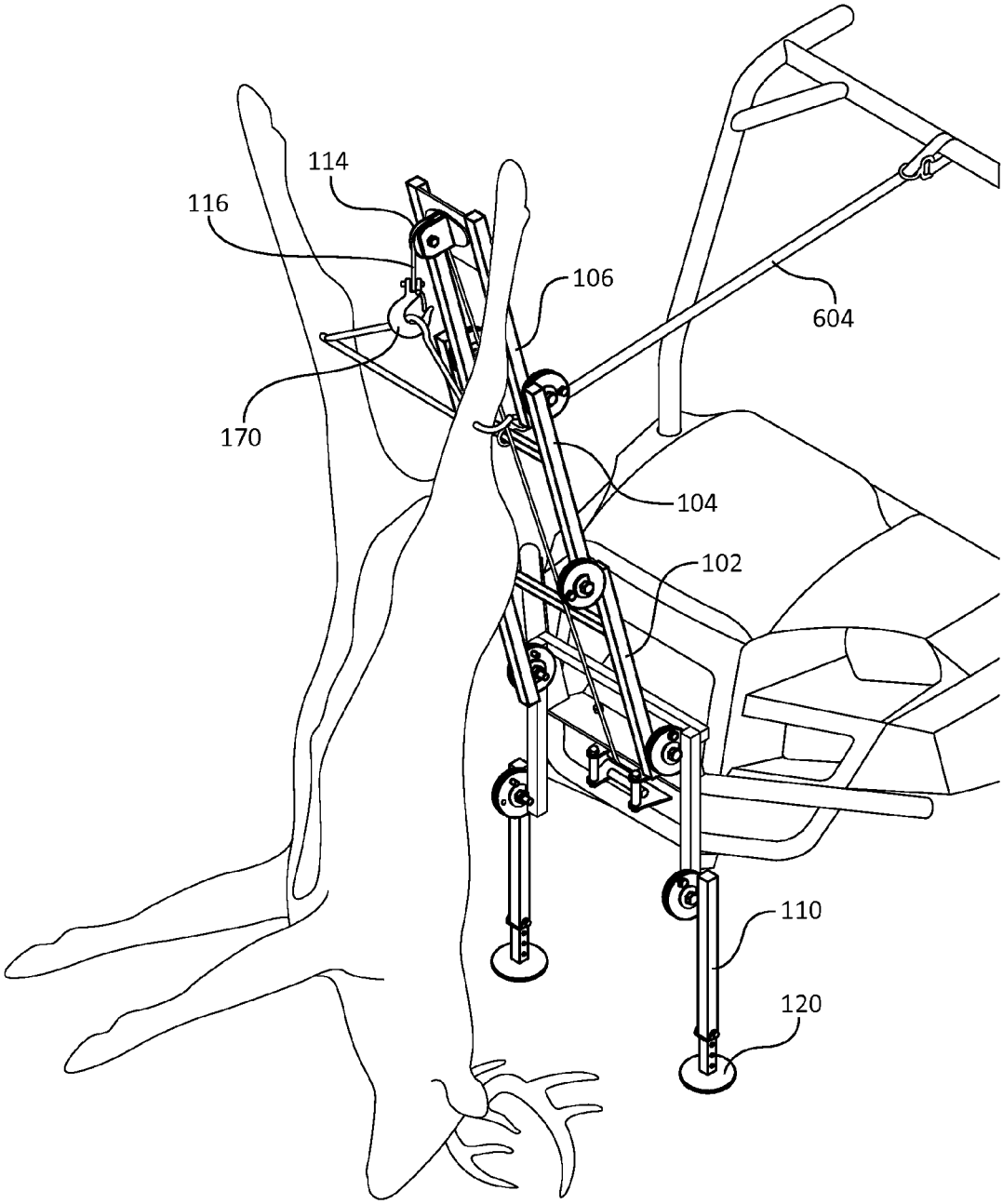
FIG. 6 is a perspective view illustration of an assembly "in use", according to one embodiment of the present invention.

In one embodiment, illustrated in FIG. 6, when performing a lift, the cable hook 170, or other suitable connecting device, is lowered using winch 118 to a desired location. A load (i.e. game animal) is secured onto the cable hook 170 or connecting device, at which point the lift may commence. Using controls for the vehicle's winch 118, an operator maneuvers the winch such that the cable 116 is winding back toward the vehicle. The cable 116, threaded through pulley 114, and upper winch guide 722, is maneuvered upward until the load being hoisted is at a desired height, at which point the operator stops winch 118 from operating. Using the lower winch guide 722 as a lower torsional fulcrum support and pulley 114 as an upper torsional fulcrum support, the load is suspended using the complete boom assembly 100 as a projecting support. The weight supplied by the vehicle is more than sufficient to counter balance any load the hoist is equipped to handle.

Figure 7:
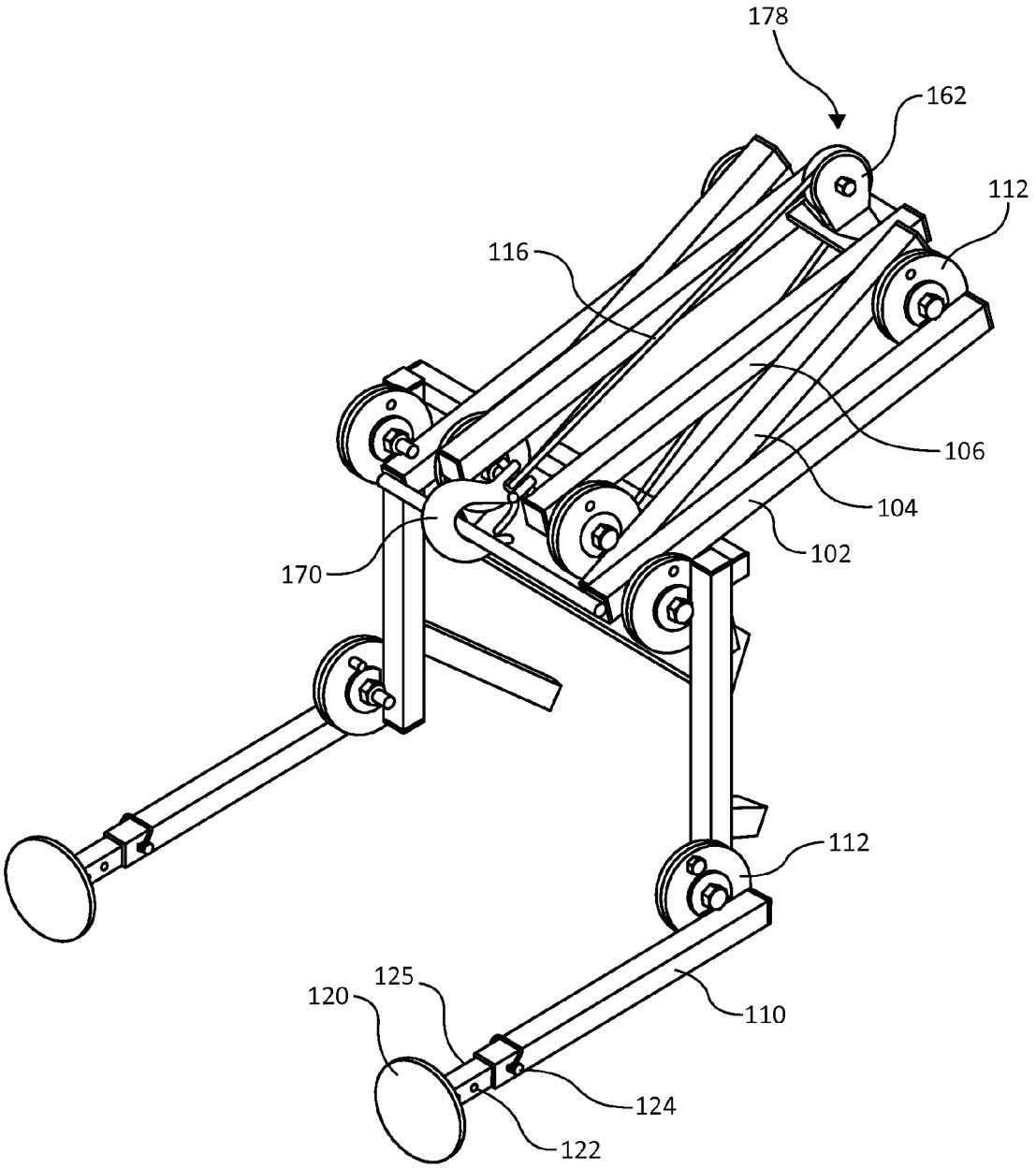
FIG. 7 is a perspective view illustration of an assembly according to one embodiment of the present invention in the collapsed, stored position and extended support posts.
Figure 8:
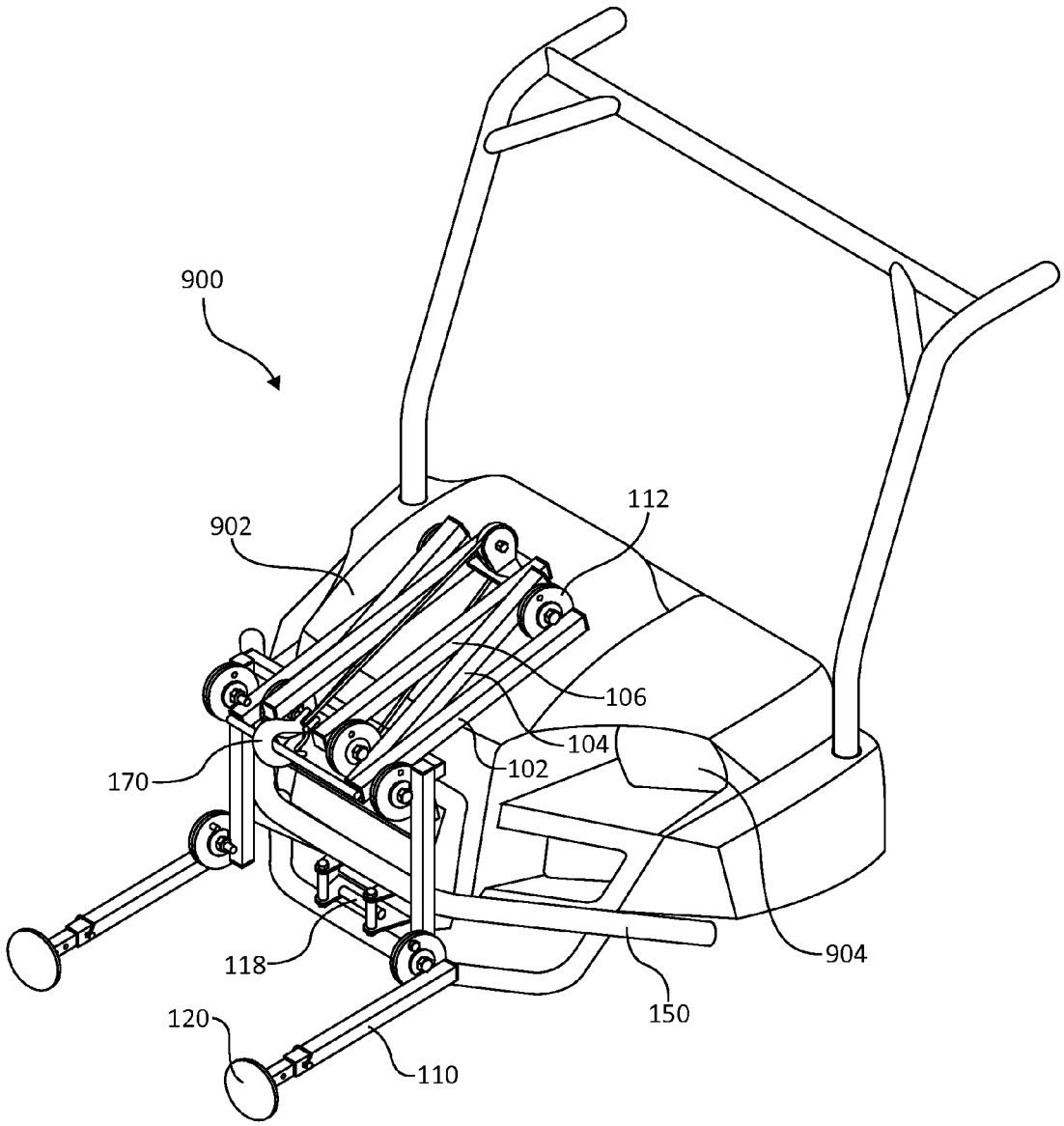
FIG. 8 is a perspective view illustration of an assembly according to one embodiment of the present invention in the collapsed, stored position.

When it is desired the hoist be put into a stored position, as illustrated in FIG. 7, fastener 126 of annular support 112 of each lower boom arms 102, middle boom arms 104, upper boom arms 106, and mounting assembly arm 108 is released, allowing the support to pivot rotationally on pivot fastener 128. Since upper boom assembly 196 is narrower than middle boom assembly 194, and middle boom assembly 194 is narrower than lower boom assembly 192, it is possible to pivot each boom assembly inward upon annular support 112, such that upper boom assembly 196 and middle boom assembly 194 fold in between and inside of each other and lower boom assembly 192 in a pleated configuration. FIG. 8 then shows the total collapsed assembly 900, is pivoted using annular support 112 of each mounting arm 108, back toward the hood of the vehicle until the apertures on each annular plate, configured for a storage position, align. Fastener 126 is then threaded and secured into the aligned apertures as to prohibit further rotational movement and secure the boom assemblies in place.

Figure 9:
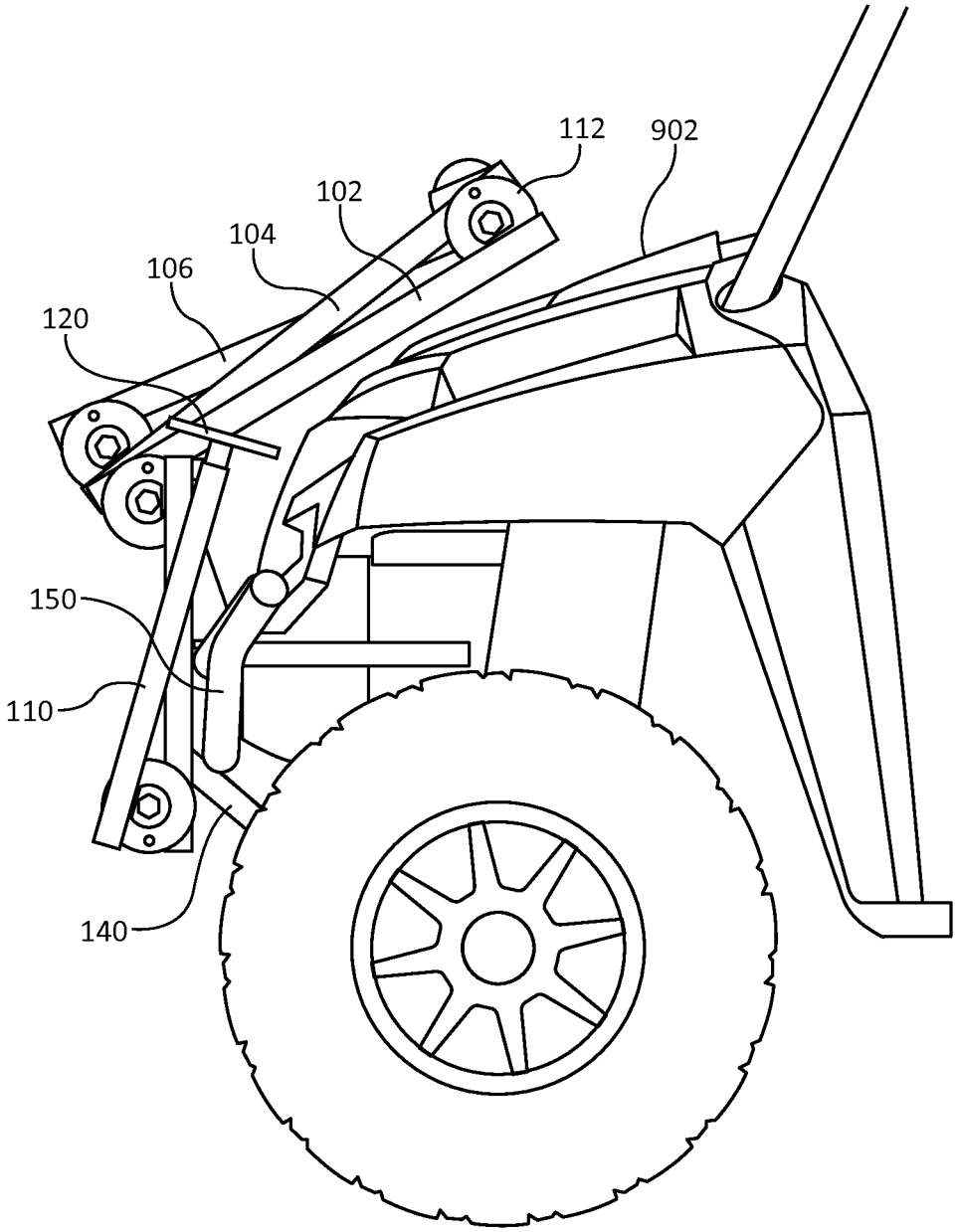
FIG. 9 is a perspective view illustration of a mounting assembly according to one embodiment of the present invention.

As illustrated in FIG. 9, the apertures configured for a storage position of annular support 112 on each boom assembly are positioned in such a way that when the complete assembly is in the folded, collapsed, storage position, and pivoted rotationally back toward the vehicle, no portion of any section of the complete assembly contacts, meets or rests upon the hood of the vehicle, but rather is secured into a storage position in which the assembly floats above, but closely to the hood of the vehicle, as to not inhibit vehicle operation.

Figure 2:
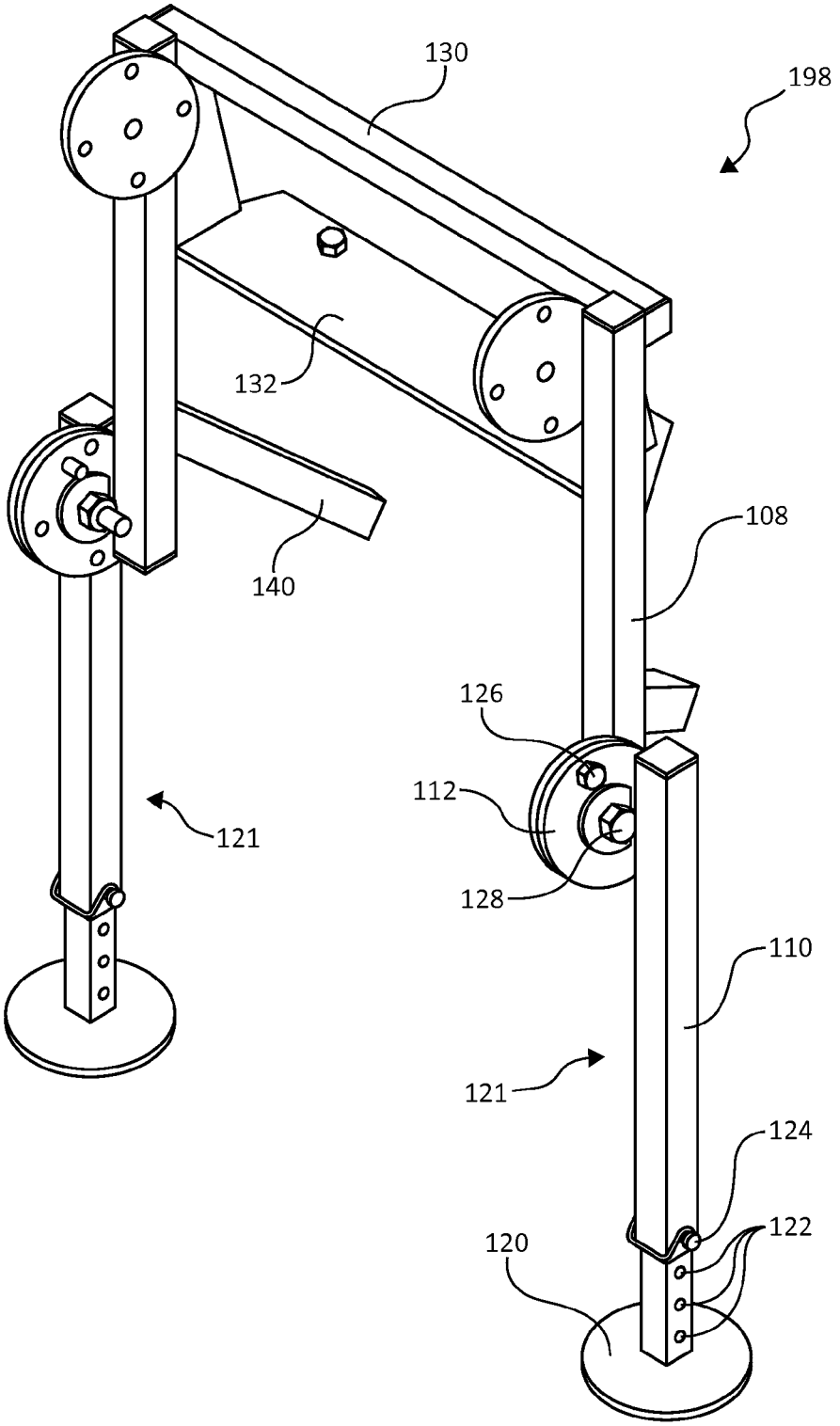
FIG. 2 is a perspective view illustration of the support posts according to one embodiment of the present invention, extended in a supporting position.
Figure 10:
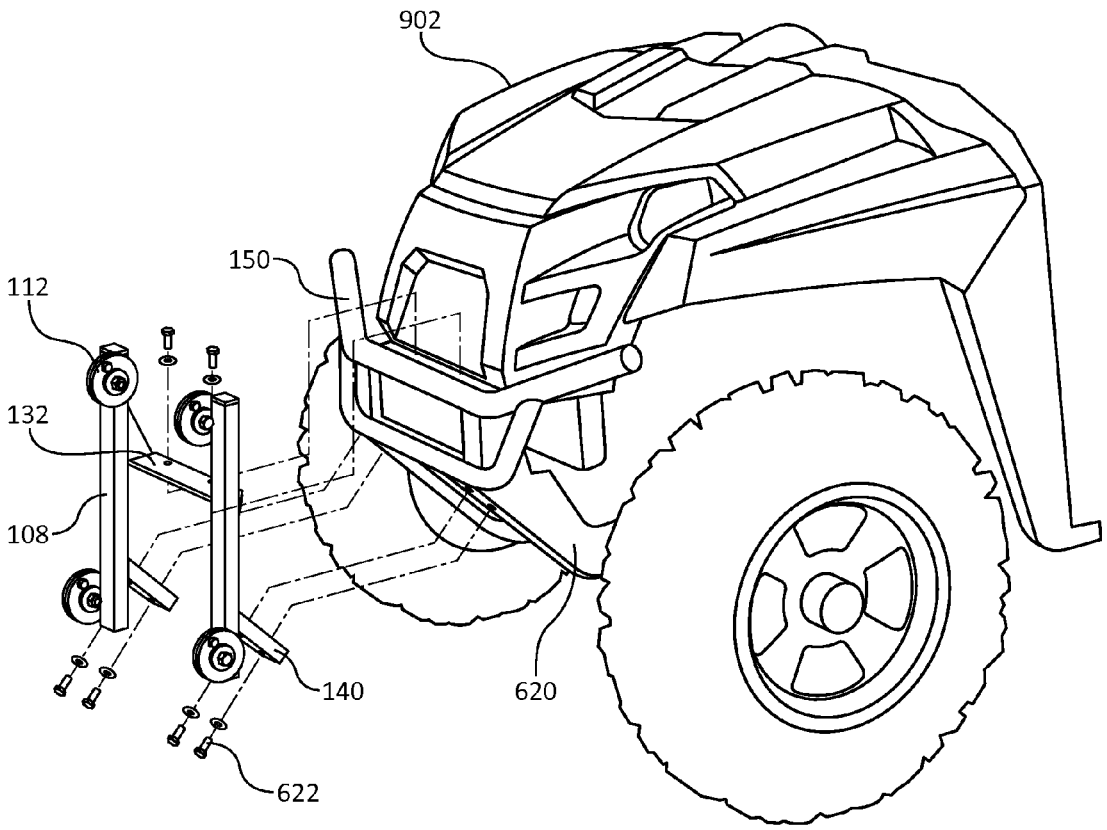
FIG. 10 is an enlarged, sectional view illustration of a mounting assembly according to one embodiment of the present invention.

The complete boom assembly 100 is attached to the vehicle (i.e. ATV or UTV 902) via a mount assembly 198 illustrated in FIG. 2. Mount assembly 198 consists of two parallel mounting arms 108 attached to each other via a perpendicular mounting cross bar 132, and two attaching arms 140, attached and projected from mounting arms 108. At a lower end of mounting arms 108, attaching arms 140 adjunct out toward the vehicle at the same angle as many common underside skid support beams 620 (illustrated in FIG. 10), commonly found on ATV's or UTV's. In one embodiment, mount assembly 198 attaches to an ATV or UTV, via common mounting points of many vehicles' skid plate assembly 720, illustrated in FIG. 11. FIG. 10 illustrates fasteners 622 are used to attach mounting bars 140 to common skid plate attachment locations, and mounting cross bar 132 (shown in FIG. 2) to common bumper mounting locations.

During installation, the mounting assembly 198 is placed adjacent to the bumper 150, and on top of common mount point locations 622, and securely fastened thereto. A fastener is threaded through mounting arms 140, and into existing apertures on common skid support beams 620. Likewise, mounting cross beam 132 is placed on top and inside of bumper 150, with fasteners threaded into existing apertures common to many vehicles. This installation technique is for convenience and security, as there is no need for any further apertures to bore through the vehicle, and the mount point locations are positioned in places that are already designed structurally sound.

ATV's may include such vehicles as the Honda® Rincon™, Honda® FourTrax Recon™, Honda® Recon™, Honda® Foreman 4×4™, Yamaha® Grizzly 750 4×4™, Can-Am® Outlander Max™, and Polaris® Sportsman 850™. UTV's may include such vehicles as the Can-Am® Commander Max™, Honda® Pioneer 500™, Polaris® Ranger 400™, and Polaris® Ranger Crew™. The aforementioned are merely a few examples of many different makes of many manufacturers the present invention is mountable to, and should be taken in such spirit. It is not intended as an aid to draw a scope of the invention, nor is it meant to be all-inclusive.

In one embodiment, attached via annular support 112 to a lower end of mounting assembly 198 are two support posts 110, and telescopic pad assemblies 121, as illustrated in FIG. 2. The telescopic pad assembly 121 includes a telescopic arm 125 configured to fit disposed inside of support posts 110, and include apertures 122 to accept a support post fastener 124. In one embodiment, the bottom of telescopic arms 125 may feature support pads 120. Support pads 120 may be circular, rectangular, pointed, or any other shape or size configuration or combination thereof suitable for use in a bracing application. Support pads 120 may be fabricated of steel, stainless steel, cast iron, alloy steel, aluminum, plastic or polymers, or any other material or combination thereof suitable for use in such an application, not limited to the aforementioned. Telescopic pad assemblies 121, including support posts 110 and telescopic arms 125 may operate telescopically independently of each other, such that on uneven ground, one support pad 120 may be lowered or raised to a different height of the other pad to make contact with the ground, to provide a total support.

Telescopic pad assembly 121 is independent of, but connected to mounting beam 108 using a pivotal annular support 112. Accordingly, telescopic pad assembly 121 may pivot coaxially and secure in a plurality of positions. This gives flexibility in the surface being supported against, as the telescopic pad assemblies 121, including support posts 110 and telescopic arms 125 both extend outwardly and inwardly and pivot rotationally. In one example, the vehicle may be positioned on unleveled terrain. The support pad 120 and telescopic pad assemblies 121 including support posts 110 and telescopic arms 125 may be employed such that telescopic arm 125 is extended telescopically further than the other telescopic arm 125, such that both assemblies make contact with the ground to provide support. In another example, it may be advantageous to brace the vehicle adverse to terrain immediately in front of it. The support pad 120 and telescopic pad assemblies 121 including support posts 110 and telescopic arms 125 may be employed such that support posts 110 are pivoted away from the vehicle, making contact and braced upon terrain immediately in front of it. The ability to secure telescopic pad assemblies 121 in a plurality of positions independently of one another is advantageous to a wide variety of useful bracing applications.

In one embodiment, there may be a further support for the torsional fulcrum weight placed upon the complete boom assembly 100 when performing a lift, provided by a support strap configuration 600, illustrated in FIG. 5, using support strap 604. Support strap 604 is connected to transversal cross beam 130 of middle boom assembly 194, and adversely to the roll cage assembly on an equipped vehicle 608. In one embodiment, the support strap 604 may be adjustable to a plurality of lengths to accommodate a plurality of boom angles. In a further embodiment, the support strap 604 may be of fixed length. The support strap 604 may be made of plastic, nylon, leather, cotton, polyester, or any other durable material or combination thereof suitable for use in such an application.

Figure 13:
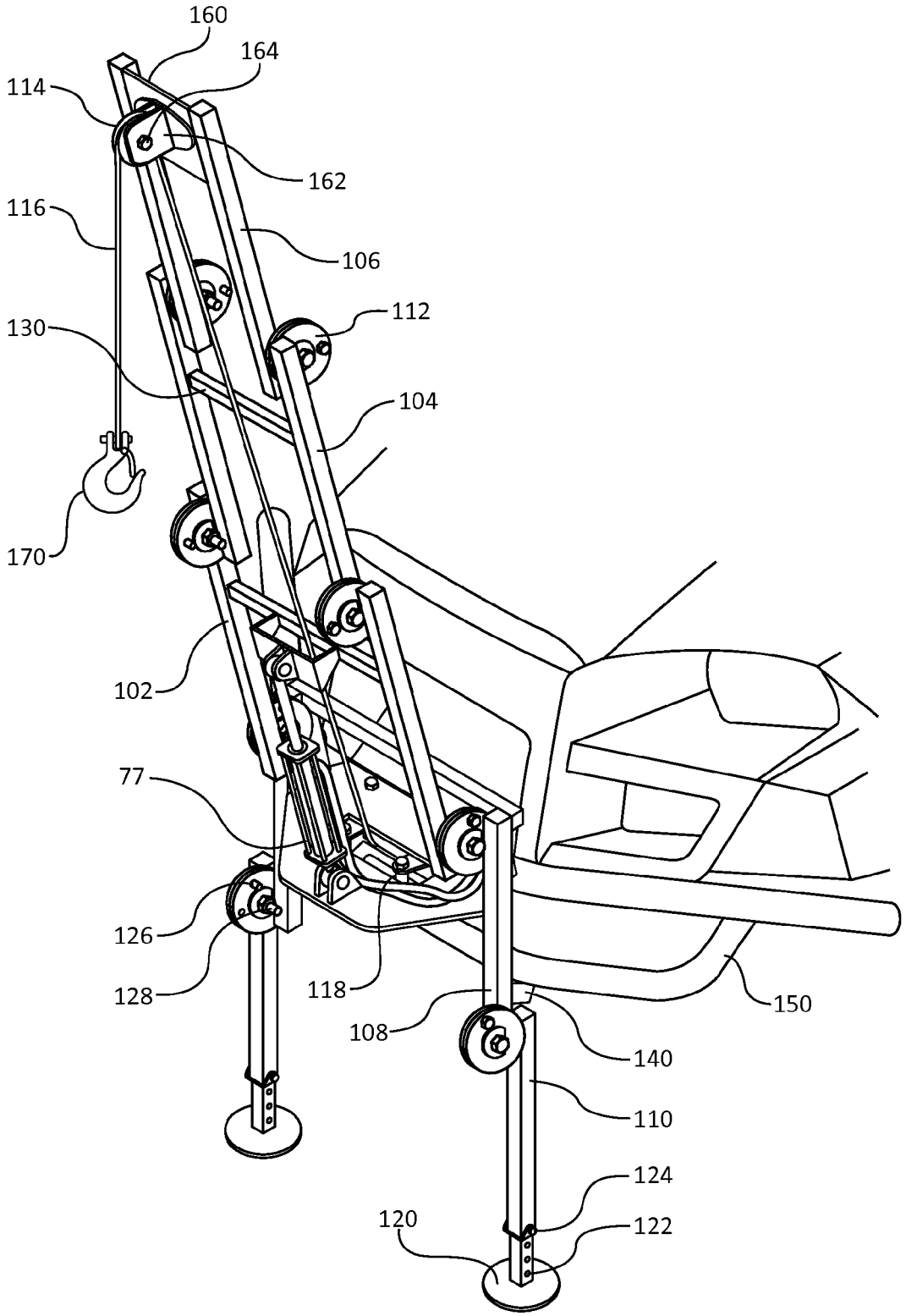
FIG. 13 is a perspective view illustration of a hydraulic assembly according to one embodiment of the present invention in the fully extended "ready for use" position.

In one embodiment, illustrated in FIG. 13, a hydraulic device 77 may be coupled to and in between lower boom assembly 192 and mounting assembly 198, and provide additional torsional support for the complete boom assembly 100 while executing a lift. In one example, the hydraulic device 77 is coupled to the vehicle's power system, with operator controls on or near the device itself. In another example, operator controls for the hydraulic device 77 may be located near or coupled to operator controls for the vehicle's winch. The hydraulic device 77 provides a further agent of lift for the complete boom assembly 100, working in concert with the vehicle's winch 118 to execute a lift.

Figure 14:
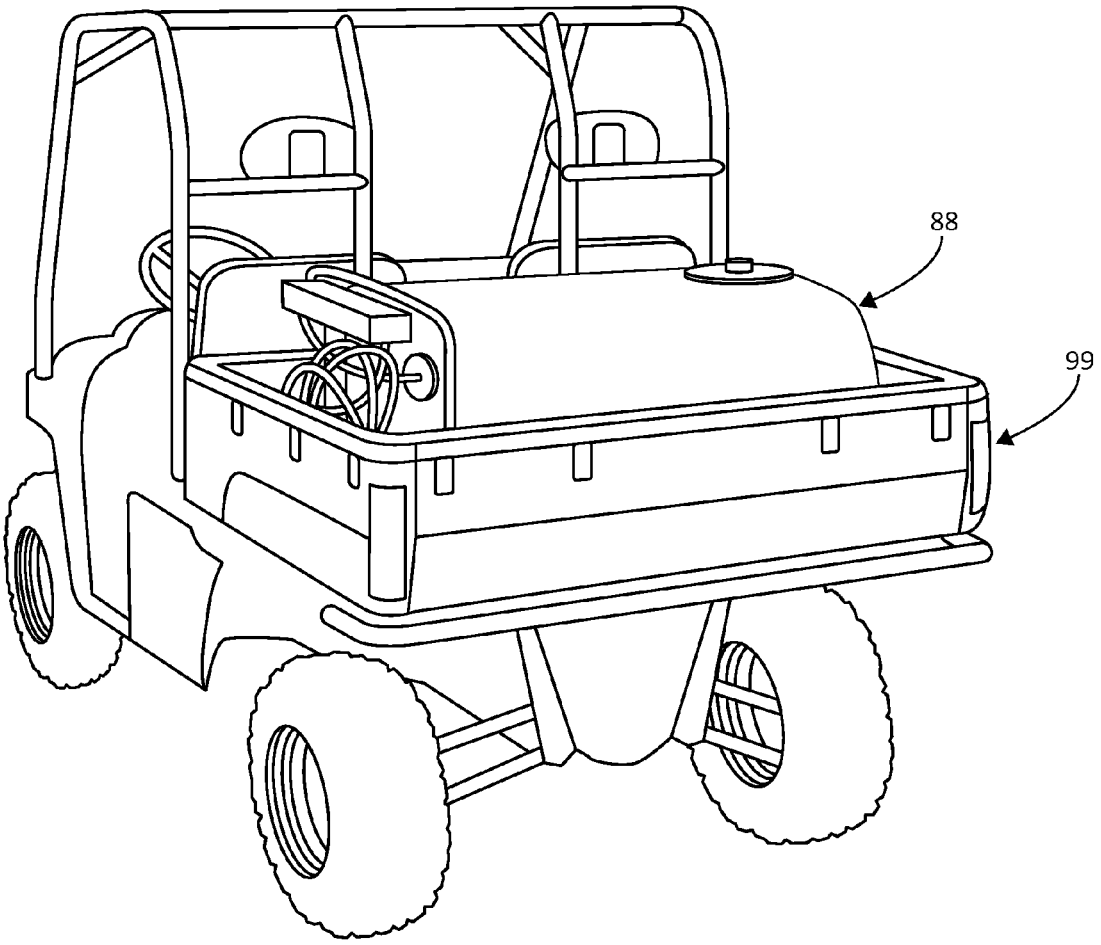
FIG. 14 is a perspective view illustration of a wash assembly according to one embodiment of the present invention.

In one embodiment, illustrated in FIG. 14, the collapsible hoisting apparatus may be coupled with a wash station located on the rear or bed 99 of the vehicle, for further aid in field dressing wild game. The wash station may have a liquid storage tank 88 (i.e. for fresh water storage) and a washable flat work area (not pictured). The wash station may include a hose coupled to the liquid storage tank, and may include a pump (not pictured). The combined weight of the wash station and storage tank aid to further offset and counterbalance a load placed on the collapsible hoist apparatus during the execution of a lift.

Although the invention has been described with respect to particular embodiments, such embodiments are meant for the purposes of illustrating examples only and should not be considered to limit the invention or the application and uses of the invention. Features of the various embodiments may be used alone and or together with features of other described embodiments. In addition, various alternatives, modifications, and changes will be apparent to those of ordinary skill in the art upon reading this application. Furthermore, there is no intention to be bound by any theory presented in the preceding background of the invention or the above detailed description.

What is claimed is:

1. A collapsible hoisting apparatus, said apparatus comprising:

a lower boom assembly coupled to a mounting assembly by at least one pivotal annular support, a middle boom assembly, and an upper boom assembly, said boom assemblies together comprising a complete boom assembly, and said boom assemblies each including two parallel boom arms and a transversal crossbeam, and each connectible to one another by the at least one pivotal annular support, said pivotal annular support pivoting on an axis; wherein the upper boom assembly includes the at least one pivotal annular support on each boom arm at a proximal end, and a cable-pulley assembly from which to hoist a load from underneath the upper boom assembly on a distal end, further wherein the at least one pivotal annular support allows the complete boom assembly to be placed in a first extended position, a fully extended position, or a closed storage position, and further wherein the at least one pivotal annular support each comprises two cylindrical plates, one plate mounted on each end of each boom arm of the lower boom assembly and one plate mounted on each end of each boom arm of the middle boom assembly.

2. The hoisting apparatus of claim 1, wherein the upper boom assembly is narrower than, and fits inside of the middle boom assembly, and the middle boom assembly is narrower than, and fits inside of the lower boom assembly.

3. The hoisting apparatus of claim 1, wherein the at least one pivotal annular support further includes a middle aperture for fastening said plates together with a fastener.

4. The hoisting apparatus of claim 1, wherein the at least one pivotal annular support further includes a plurality of apertures on an outer edge, to prohibit rotational movement and lock said plates in one of a plurality of positions, said one of a plurality of positions corresponding to an angle at which the complete boom assembly is operable.

5. The hoisting apparatus of claim 1, wherein said mounting assembly is attachable to common points on an all-terrain or utility-terrain vehicle.

6. The hoisting apparatus of claim 5, further including a support strap, wherein the support strap binds the middle boom assembly with a roll cage of the all-terrain or utility-terrain vehicle.

7. The hoisting apparatus of claim 1, further including a support post assembly, said support post assembly comprising two support posts attached to the mounting assembly by said at least one pivotal annular support.

8. The hoisting apparatus of claim 7, wherein said support post assembly with said support posts include telescopic beams.

9. A collapsible hoisting apparatus, said apparatus comprising:

a lower boom assembly coupled to a mounting assembly by at least one pivotal annular support, a middle boom assembly, and an upper boom assembly, said boom assemblies together comprising a complete boom assembly, and said boom assemblies each including two parallel boom arms and a transversal crossbeam, and connectible to one another by the at least one pivotal annular support, said pivotal annular support pivoting on an axis; wherein the upper boom assembly includes the at least one pivotal annular support on each boom arm at a proximal end, and a cable-pulley assembly from which to hoist a load from underneath the upper boom assembly on a distal end, further wherein the at least one pivotal annular support allows the complete boom assembly to be placed in a first extended position, such that the boom assemblies extend outwardly, aligned in a pleated configuration; a fully extended position, such that the boom assemblies extend outwardly, aligned in a planar configuration; or a closed storage position, such that the boom assemblies extend inwardly, aligned in a pleated configuration, and further wherein the at least one pivotal annular support each comprises two cylindrical plates, one plate mounted on each end of each boom arm of the lower boom assembly and one plate mounted on each end of each boom arm of the middle boom assembly.

10. The hoisting apparatus of claim 9, wherein the upper boom assembly is narrower than, and fits inside of the middle boom assembly, and the middle boom assembly is narrower than, and fits inside of the lower boom assembly.

11. The hoisting apparatus of claim 9, wherein the at least one pivotal annular support further includes a middle aperture for fastening said plates together with a fastener.

12. The hoisting apparatus of claim 9, wherein the at least one pivotal annular support further includes a plurality of alignable apertures on an outer edge of each said plate, for inserting a fastener to prohibit rotational movement and lock said plates together in one of a plurality of positions, said one of a plurality of positions corresponding to an angle at which the complete boom assembly is operable.

13. The hoisting apparatus of claim 9, wherein said mounting assembly is attachable to common points on an all-terrain or utility-terrain vehicle.

14. The hoisting apparatus of claim 13, further including a support strap, wherein the support strap binds the transversal cross beam of the middle boom assembly with a roll cage of the all-terrain or utility-terrain vehicle.

15. The hoisting apparatus of claim 9, further including a support post assembly, said support post assembly comprising two support posts attached to the mounting assembly by said at least one pivotal annular support.

16. The hoisting apparatus of claim 15, wherein said support post assembly with said support posts include telescopic beams disposed inside said support posts.

17. A method of manufacturing a collapsible hoisting apparatus, the method comprising:

forming a lower boom assembly coupled to a mounting assembly by at least one pivotal annular support, a middle boom assembly, and an upper boom assembly, said boom assemblies together comprising a complete boom assembly, and said boom assemblies each including two parallel boom arms and a transversal crossbeam, and connectible to one another by the at least one pivotal annular support, said pivotal annular support pivoting on an axis; wherein the upper boom assembly includes the at least one pivotal annular support on each boom arm at a proximal end, and a cable-pulley assembly from which to hoist a load from underneath the upper boom assembly on a distal end, further wherein the at least one pivotal annular support allows the complete boom assembly to be placed in a first extended position, a fully extended position, or a closed storage position, and further wherein the at least one pivotal annular support each comprises two cylindrical plates, one plate mounted on each end of each boom arm of the lower boom assembly and one plate mounted on each end of each boom arm of the middle boom assembly.

18. The method of claim 17, wherein the upper boom assembly is narrower than, and fits inside of the middle boom assembly, and the middle boom assembly is narrower than, and fits inside of the lower boom assembly.

19. The method of claim 17, wherein the at least one pivotal annular support further includes a middle aperture for fastening said plates together with a fastener.

20. The method of claim 17, wherein the at least one pivotal annular support further includes a plurality of apertures on an outer edge, for inserting a fastener to prohibit rotational movement and lock said plates in one of a plurality of positions, said on of a plurality of positions corresponding to an angle at which the complete boom assembly is operable.

* * * * *